US006793744B1

(12) United States Patent
Jung

(10) Patent No.: US 6,793,744 B1
(45) Date of Patent: Sep. 21, 2004

(54) MARTENSTIC STAINLESS STEEL HAVING HIGH MECHANICAL STRENGTH AND CORROSION

(75) Inventor: Jae-Young Jung, Pohang (KR)

(73) Assignee: Research Institute of Industrial Science & Technology, Kyungsangbuk-dg (KR)

( * ) Notice: Subject to any disclaimer, the term of this patent is extended or adjusted under 35 U.S.C. 154(b) by 44 days.

(21) Appl. No.: 09/713,775

(22) Filed: Nov. 15, 2000

(51) Int. Cl.[7] ..... C22C 38/44; C22C 8/00

(52) U.S. Cl. ..... 148/325; 148/542; 148/547; 148/607; 148/608; 420/67; 420/68; 420/69; 420/57; 420/59

(58) Field of Search ..... 148/325, 542, 148/647, 607, 608; 420/67–69, 57, 59

(56) References Cited

U.S. PATENT DOCUMENTS

| | | | | |
|---|---|---|---|---|
| 3,574,601 A | | 4/1971 | Myers et al. | 75/125 |
| 3,700,851 A | * | 10/1972 | Bjorkroth | 420/57 |
| 5,415,706 A | * | 5/1995 | Scarlin et al. | 148/325 |

FOREIGN PATENT DOCUMENTS

| | | | | |
|---|---|---|---|---|
| EP | 0 639 691 A1 | | 2/1995 | F01D/5/02 |
| EP | 1 314 791 A1 | | 5/2003 | C22C/38/00 |
| FR | 2 566 429 | | 6/1985 | C22C/38/48 |
| GB | 1248985 | | 10/1971 | C22C/39/26 |
| GB | 2179675 A | | 3/1987 | C22C/38/40 |
| JP | 54-11245 | | 5/1979 | C22C/38/40 |
| JP | 2-101143 | | 4/1990 | C22C/38/00 |
| JP | 402217444 A | * | 8/1990 | |
| JP | 2-236257 | | 9/1990 | C22C/38/00 |
| JP | 3-75338 | | 3/1991 | C22C/38/00 |
| JP | 3-75339 | | 3/1991 | C22C/38/00 |
| JP | 3-153848 | | 7/1991 | C22C/38/00 |
| JP | 4-72039 | | 3/1992 | C22C/38/00 |
| JP | 404120249 A | * | 4/1992 | |
| JP | 5-63544 | | 9/1993 | C22C/38/00 |
| JP | 7-138711 | | 5/1995 | C22C/38/00 |
| JP | 7-166303 | | 6/1995 | C22C/38/00 |
| JP | 7-242935 | | 9/1995 | C21D/6/00 |
| JP | 7-324631 | | 12/1995 | F02C/3/06 |
| JP | 2503180 | | 3/1996 | F02C/3/06 |
| JP | 225833 | | 9/1996 | C21D/6/00 |
| JP | 8-246107 | | 9/1996 | C22C/38/00 |
| JP | 408246107 A | * | 9/1996 | |
| JP | 2742948 | | 2/1998 | C22C/38/00 |
| JP | 2742949 | | 2/1998 | C22C/38/00 |
| JP | 2745070 | | 2/1998 | C22C/38/00 |
| JP | 10-130787 | | 5/1998 | C22C/38/00 |
| JP | 2791804 | | 6/1998 | C22C/38/00 |
| JP | 11-350031 | | 12/1999 | C21D/8/02 |
| JP | 2000-192196 | | 7/2000 | C22C/38/00 |
| WO | WO 92/00158 | | 1/1992 | B22F/3/14 |

* cited by examiner

*Primary Examiner*—Deborah Yee
(74) *Attorney, Agent, or Firm*—Fish & Richardson P.C.

(57) ABSTRACT

The present invention relates to a martensitic stainless steel that can be used in manufacturing articles such as a shaft or an impeller which require high mechanical strength and corrosion resistance and provides a martensitic stainless steel comprising less than 0.06 wt. % C, less than 2.5 wt. % Si, less than 2.5 wt. % Mn, 1.0–6.0 wt. % Ni, 10.0–19.0 wt. % Cr, 0.5–6.0 wt. % W, less than 3.5 wt. % Mo, less than 0.5 wt. % Nb, less than 0.5 wt. % V, less than 3.0 wt. % Cu, 0.05–0.25 wt. % N, and the remainder being Fe and minor impurities.

8 Claims, 2 Drawing Sheets

MARTENSTIC STAINLESS STEEL HAVING HIGH MECHANICAL STRENGTH AND CORROSION

BACKGROUND OF THE INVENTION (a) Field of the Invention

The present invention relates to a martensitic stainless steel, and more particularly, to a martensitic stainless steel that can be used in manufacturing articles such as a shaft or an impeller or a knife which require high mechanical strength and corrosion resistance.

(b) Description of the Related Art

Generally, stainless steel is classified according to its main element, as martensitic stainless steel, austenitic stainless steel, ferritic stainless steel, duplex stainless steel, precipitation hardening stainless steel, and superstainless steel.

Such stainless steels guarantee necessary mechanical strength and corrosion resistance. Therefore, they are widely used to manufacture industrial equipment and parts thereof requiring such characteristics.

Particularly, the well-known 410 or 420-martensitic stainless steel has high mechanical strength, being used as a material for manufacturing boiler pump impellers that are subject to high centrifugal force or pipes for delivering fluid containing abrasive particles.

A recently developed power plant has been designed such that the inlet temperature of a boiler turbine is increased to improve fuel efficiency. Furthermore, the rotational speed of the turbine pump is also increased. Therefore, there is a need for a material which can endure the rigorous conditions of the power plant.

Particularly, components of a boiler feed pump should have high corrosion and wear resistance as well as high mechanical strength, since it must convey fluid containing oxide scale or fine solid particles such as, coal or sand which cause abrasion of the components.

However, the 410 and 420J-martensitic stainless steels, which have been used to manufacture components of the conventional boiler feed pump and have high mechanical strength, have a disadvantage in that they have a relauvely low corrosion resistance.

That is, since the martensitic stainless steel contains a relatively high carbon weight and 12–18% chrome, the mechanical strength thereof can be increased to a high level through a heat-treatment process. But since chrome carbide is precipitated on the grain boundary due to the high carbon content, a chrome-exhausted layer is easily formed, deteriorating the corrosion resistance.

A supermartensitic 248SV alloy developed by Avesta Sheffield Company is well known as a material used for manufacturing the boiler feed pump. This alloy is improved in terms of corrosion resistance by reducing the carbon content, increasing the chrome content and adding nickel. However, since it is difficult in the alloy to have high percentage of martensitic structure owing to the adding nickel which is one of austenite stabilizing element, the alloy is deteriorated in terms of mechanical strength.

Japanese Patent No. JP-61030665 discloses a stainless steel which is improved in terms of corrosion resistance with respect to seawater and other fluids. However, since the stainless steel contains 3.5–7.0% cobalt, the manufacturing cost is increased. Furthermore, more than 0.08% carbon content deteriorates the corrosion resistance.

SUMMARY OF THE INVENTION

Therefore, there is a need for a stainless steel which has both high mechanical strength and high corrosion resistance such that it can be optimally used for manufacturing a boiler feed pump impeller and shaft.

The present invention has been made in an effort to meet the above need.

To meet the above need, the present invention provides a martensitic stainless steel comprises less than 0.06 wt. % C, less than 2.5 wt. % Si, less than 2.5 wt. % Mn, 1.0–6.0 wt. % Ni, 10.0–19.0 wt. % Cr, 0.5–6.0 wt. % W, less than 3.5 wt. % Mo, less than 0.8 wt. % Nb, less than 0.8 wt. % V, less than 3.0 wt. % Cu, 0.04–0.25 wt. % N, and the remainder being Fe and minor impurities.

Preferably, the martensitic stainless steel may further comprise at least one of less than 0.8 wt. % Ti and/or 1.0 wt. % Ta.

According to another aspect of the present invention, a martensitic stainless steel comprises less than 0.035 wt. % C, less than 2.0 wt. % Si, less than 2.0 wt. % Mn, 1.5–4.5 wt. % Ni, 12.0–16.0 Wt. % Cr, 0.5–4.5 wt. % W, less than 2.5 wt. % Mo, less than 0.3 wt. % Nb, less than 0.3 wt. % V, less than 2.0 wt. % Cu, 0.08–0.20 wt. % N, and the remainder being Fe and minor impurities.

According to another aspect of the present invention, a method for manufacturing a martensitic stainless steel comprises the steps of casting a stainless steel comprises less than 0.06 wt. % C, less than 2.5 wt. % Si, less than 2.5 wt. % Mn, 1.0–6.0 wt. % Ni, 10.0–19.0 wt. % Cr, 0.5–6.0 wt. % W, less than 3.5 wt. % Mo, less than 0.8 wt. % Nb, less than 0.8 wt. % V, less than 3.0 wt. % Cu. 0.04–0.25 wt. % N, and remainder being Fe and minor impurities; and submitting the cast stainless steel to an austenization heat treatment at a temperature of 800–1150° C. and/or tempering the stainless steel at a temperature of 350–575° C.

According to still another aspect of the present invention, a method for manufacturing a martensitic stainless steel comprises the steps of casting a stainless steel comprises less than 0.06 wt. % C, less than 2.5 wt. % Si, less than 2.5 wt. % Mn, 1.0–6.0 wt. % Ni, 10.0–19.0 wt. % Cr, 0.5–6.0 wt. % W, less than 3.5 wt. % Mo, less than 0.8 wt. % Nb, less than 0.8 wt. % V, less than 3.0 wt. % Cu, 0.04–0.25 wt. % N, and remainder being Fe and minor impurities; mechanical-processing the stainless steel such that work hardening is generated in the stainless steel; and submitting the mechanical-processed stainless steel to austenization heat treatment at a temperature of 800–1150° C. and/or tempering the stainless steel at a temperature of 350–575° C.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

Figure 1:
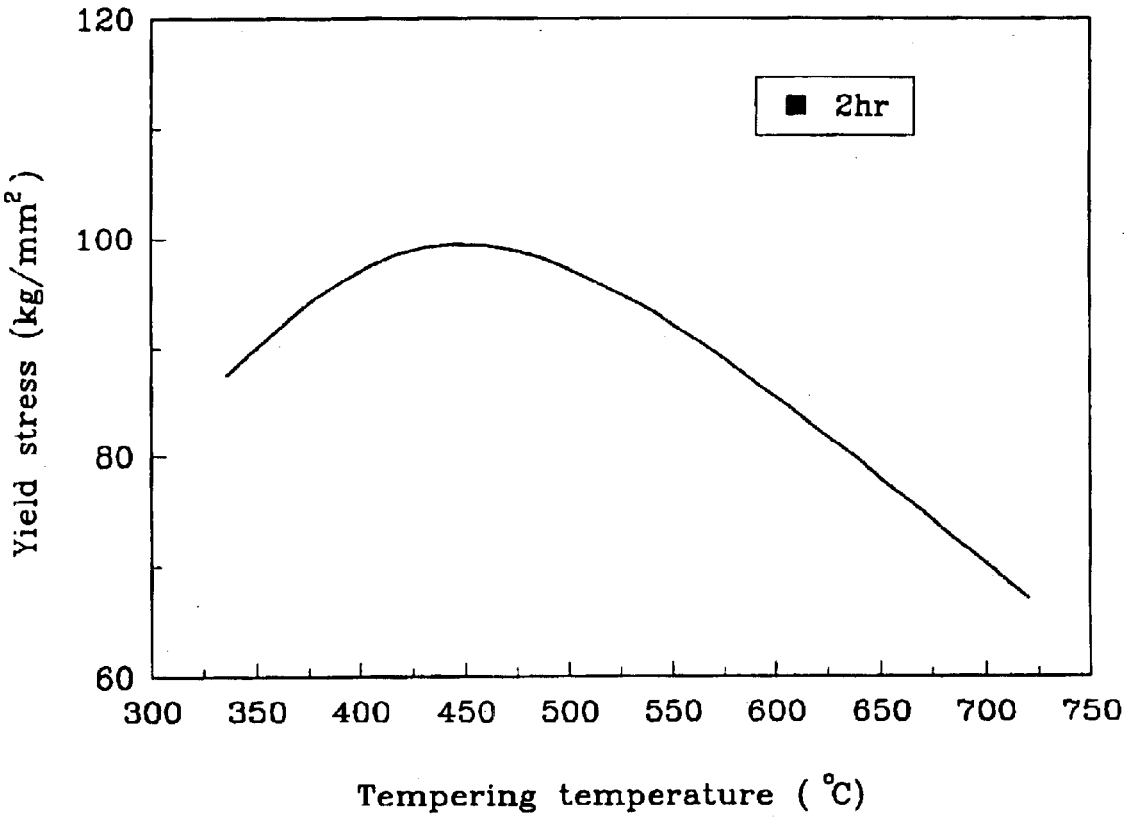
FIG. 1 is a graph illustrating variation in yield stress of a test sample of a preferred embodiment of the present invention according to a variation of tempering temperature.

A preferred embodiment of the present invention will be described hereinafter with reference to the accompanying drawings.

The inventive martensitic stainless steel comprises less than 0.06 wt. % C, less than 2.5 wt. % Si, less than 2.5 wt.

% Mn, 1.0–6.0 wt. % Ni, 10.0–19.0 wt. % Cr, 0.5–6.0 wt. % W, less than 3.5 wt. % Mo, less than 0.8 wt. % Nb, less than 0.8 wt. % V, less than 3.0 wt. % Cu, 0.04–0.25 wt. % N, with the remainder being Fe and minor impurities. The composition of the martensitic stainless steel will be described in detail.

The carbon is a carbide forming element being bonded with a metal element such as Cr, Mo, W, Nb and V, increasing the strength of the steel. Since the precipitation amount of chrome carbide is increased when the carbon content is increased to 0.15 wt. % as in conventional 410-martensitic steel, less than 0.06 wt. % carbon is added, and more preferably less than 0.035 wt. %, in the present invention.

The silicon which is a residual element in a cast metal and may added as a casting agent to increase the fluidity of liquid metal is limited to less than 2.5 wt. % so as to prevent the mechanical properties from deteriorating. It is more preferable to add the silicon to less than 2.0 wt. %.

When the Mn is above 2.5 wt. %, mechanical properties such as ductility of the metal deteriorate. It is more preferable to add the Mn to less than 2.0 wt. %.

The Ni is an austenitic forming element. In the present invention, since the content of C is less than 0.06 wt. %, the content of the Ni should be above at least 1.0 wt. %. However, when the content of the Ni is higher than 6.0 wt. %, the martensite transformation point and the eutectoid temperature(Ac1) are greatly decreased and over-aging occurs, lowering the quenching resistance. Accordingly, the Ni is preferably added to 1.0–6.0 wt. %. However, it is further preferable to add the Ni to 1.5–4.5 wt. % to form a uniform martensite structure and improve mechanical strength.

The Cr is added to improve corrosion resistance, thereby effectively preventing high temperature oxidation and corrosion. However, when the content of Cr is less than 10 wt. %, the corrosion resistance is deteriorated, and when higher than 19.0 wt. %, the mechanical strength is deteriorated by stabilizing δ-Ferrite. Therefore, it is preferable to add the Cr to 12.0–16.0 wt. %.

The W is added to improve both the mechanical strength at a high temperature and the tempering resistance by forming a carbide such as $M_2C$ (M is a metal element) by bonding with C. Particularly, the W improves pitting resistance at a predetermined pH. However, when the W is added at less than 0.5 wt. %, such effects cannot be obtained, and when higher than 6.0 wt. %, a large amount of ferrite is formed, the strength deteriorates and the martensitic transformation point is lowered, making it difficult to obtain martensite structure. Therefore, it is preferable to add the W to 0.5–4.5 wt. %.

The Mo is added to improve the pitting resistance as well as the mechanical strength. It is preferable to add the Mo to less than 3.5 wt. %, and more preferably, to less than 2.5 wt. %.

The Nb and V are added to form NbC and $V_4C_3$, respectively, thereby increasing the mechanical strength at a high temperature. If each of the Nb and V is added to more than 0.8 wt. %, the toughness and the ductility are deteriorated. Therefore, it is preferable to add each of the Nb and V to less than 0.8 wt. %, and more preferably, to less than 0.3 wt. %.

The Cu is added to improve the corrosion resistance and the hardenability against high temperature steam by improving the fine grain size and to improve the mechanical strength by precipitating a kind of Cu compound. However, more than 3.0 wt. % of Cu causes the segregation of an ingot, deteriorating the material. Therefore, it is preferable to add the Cu to less than 2.0 wt. %.

In the present invention, the content of the C is decreased when compared with the conventional martensitic stainless steel, and the N is additionally added to reduce the δ-ferrite and to stabilize austenite. In addition, the N delays the transition of the steel to a large carbide such as $M_{23}C_6$ so as to prevent the deterioration of the corrosion resistance caused by the exhausting of the Cr. To achieve this effect, the N should be added to more than 0.04 wt. %. However, when the content of the N is above 0.25 wt. %, the temperature at which martensite transformation starts is lowered, thereby deteriorating the toughness of the stainless steel. Therefore, it is preferable to add the N to 0.08–0.20 wt. %.

The martensitic stainless steel having the above described composition can be used as a casting articles or after it is processed in a sheet or rod through forging, rolling, and extrusion processes.

In addition, the martensitic stainless steel can be used as a growing welding wire for growing high quality element on a surface of normal carbon steel.

When the martensitic stainless steel is used to manufacture a cast article through a simple mechanical process such as grinding without generating any work hardening, it is preferable to perform an austanization heat treatment at a temperature of about 800–1150° C. so as to remove a casting segregation and to homogenize microstructure. Selectively, it is also preferable to perform the tempering process at a temperature of about 350–575° C. after going through the austanization heat treatment so as to improve the mechanical characteristics of the articles.

When the martensitic stainless steel is used to manufacture an article through a mechanical process generating work hardening such as forging, rolling, and extrusion processes, it is preferable to perform the austanization heat treatment at a temperature of about 800–1150° C. and/or then perform the tempering heat treatment at a temperature of about 350–575° C. so as to improve the mechanical characteristics of the article.

Now a preferred embodiment of the present invention will be described based on actual examples.

EXAMPLE

The following Table 1 shows the composition of various examples and comparative examples of martensitic stainless steel relating to the above-described invention. A steel having the composition as shown in Table 1 below was melted in a vacuum melting furnace and cast into a 150×150×300 mm size of ingot.

TABLE 1

| | COMPOSITION (wt. %) | | | | | | | | | | | | | |
|---|---|---|---|---|---|---|---|---|---|---|---|---|---|---|
| | C | Si | Mn | Ni | Cr | Mo | W | Nb | V | Cu | Ti | Ta | N | Fe |
| Example 1 | 0.03 | 0.32 | 0.4 | 2.0 | 12.5 | 1.5 | 1.0 | 0.1 | 0.1 | — | — | — | 0.12 | Residue |
| Example 2 | 0.03 | 0.31 | 0.5 | 2.0 | 13.0 | 1.5 | 1.0 | — | — | — | 0.05 | 0.1 | 0.21 | Residue |

TABLE 1-continued

| | COMPOSITION (wt. %) | | | | | | | | | | | | | |
|---|---|---|---|---|---|---|---|---|---|---|---|---|---|---|
| | C | Si | Mn | Ni | Cr | Mo | W | Nb | V | Cu | Ti | Ta | N | Fe |
| Example 3 | 0.02 | 0.40 | 0.4 | 5.0 | 16.0 | 1.0 | 0.5 | 0.1 | 0.1 | 0.5 | — | — | 0.08 | Residue |
| Example 4 | 0.03 | 0.25 | 0.4 | 2.0 | 16.0 | 0.5 | 3.0 | 0.1 | 0.2 | 0.4 | — | — | 0.21 | Residue |
| Example 5 | 0.02 | 0.32 | 0.3 | 3.0 | 18.0 | 1.0 | 0.5 | 0.15 | 0.12 | 0.7 | — | — | 0.20 | Residue |
| Example 6 | 0.02 | 0.35 | 0.7 | 2.1 | 13.2 | 1.7 | 1.1 | 0.1 | 0.1 | — | — | — | 0.11 | Residue |
| Example 7 | 0.03 | 0.40 | 0.5 | 2.0 | 15.8 | 0.6 | 3.2 | 0.1 | 0.2 | 0.4 | — | — | 0.15 | Residue |
| Example 8 | 0.05 | 0.43 | 0.6 | 2.1 | 13.6 | 2.0 | 1.0 | 0.1 | 0.1 | — | — | — | 0.13 | Residue |
| Comparative Example 1 | 0.15 | 0.40 | 0.7 | — | 12.1 | — | — | — | — | — | — | — | 0.01 | Residue |
| Comparative Example 2 | 0.21 | 0.41 | 0.7 | — | 12.8 | — | — | — | — | — | — | — | 0.01 | Residue |
| Comparative Example 3 | 0.32 | 0.5 | 0.6 | — | 13.1 | — | — | — | — | — | — | — | 0.01 | Residue |
| Comparative Example 4 | 0.02 | 0.42 | 0.7 | 5.0 | 16.0 | 1.0 | — | — | — | — | — | — | 0.01 | Residue |
| Comparative Example 5 | 0.10 | 0.40 | 0.6 | 2.0 | 13.8 | 2.2 | 1.0 | 0.1 | 0.1 | — | — | — | 0.13 | Residue |
| Comparative Example 6 | 0.19 | 0.42 | 0.6 | 2.1 | 13.7 | 2.0 | 1.0 | 0.1 | 0.1 | — | — | — | 0.12 | Residue |

The ingots were cut to a 75×75×150 mm size. Then the test samples were prepared by submitting it to an austenization heat treatment for 2 hours at a temperature of 1100° C.

An hardness test was measured using Vickers hardness tester, and yield stress and elongation were measured using an universal tester. In addition, corrosion characteristics were estimated by measuring a critical pitting corrosion temperature.

In addition, the corrosion resistance was performed using 10% $FeCl_3.6H_2O$ solution while varying the temperature from 0° C. to 10° C. according to ASTM G48A standard. In addition, the corrosion rate is measured using 10% $FeCl_3.6H_2O$ solution according to ASTM G46A standard.

The hardness, elongation, corrosion of the samples are shown in the following Table 2.

TABLE 2

| | Hardness (Hv) | Yield Strength (Kg/mm$^2$) | Elongation (%) | Critical Pitting Temperature (° C.) |
|---|---|---|---|---|
| Example 1 | 418 | 105.8 | 10.2 | <10.0 |
| Example 2 | 475 | 120.8 | 8.6 | <20.0 |
| Example 3 | 392 | 98.8 | 12.0 | <10.0 |
| Example 4 | 425 | 106.0 | 11.0 | <30.0 |
| Example 5 | 430 | 109.5 | 12.0 | <30.0 |
| Example 6 | 429 | 110.2 | 11.0 | <10.0 |
| Example 7 | 312 | 80.5 | 11.2 | <20.0 |
| Comparative Example 1 | 307 | 78.5 | 17.0 | <0.0 |
| Comparative Example 2 | 381 | 99.0 | 11.2 | <0.0 |
| Comparative Example 3 | 412 | 105.2 | 9.8 | <0.0 |
| Comparative Example 4 | 302 | 78.0 | 14.5 | <0.0 |

As shown in Table 2, the examples 1–7 manufactured according to the present invention improved in hardness and yield stress when compared with the comparative examples 1–4. Hardness and yield stress of some of the examples showed an improvement of 30% when compared with the comparative examples. Elongation of the examples was almost identical to those of the compared examples.

In addition, the critical pitting corrosion temperature of the examples 1–7 were formed below 10–30° C., while those of the comparative examples were formed below 0° C. This shows that the corrosion characteristics of the examples according to the present invention are improved when compared with the comparative examples.

The following Table 3 shows corrosion rate of the examples and comparative examples.

TABLE 3

| | Corrosion rate (mm/year) |
|---|---|
| Example 6 | 1.7 |
| Example 7 | 2.5 |
| Example 8 | 2.9 |
| Example Comparative 5 | 3.7 |
| Example Comparative 6 | 6.4 |

As shown in Table 3, as the C content increases, the corrosion rate also increases. This shows that the lower the content of C, the lower the corrosion rate of the stainless steel.

The following Table 4 shows a corrosion rate according to a heat treatment of the martensitic stainless steel.

TABLE 4

| | Corrosion rate (mm/year) | |
|---|---|---|
| | Example 6 | Example 7 |
| As Cast | 13.0 | 17.3 |
| After Austenization heat treatment | 1.7 | 2.5 |

As shown in Table 4, the corrosion rate of samples as cast without going through any heat treatment is faster than that of samples which go through the austnization heat treatment. This shows that by performing the heat treatments, the stainless steel can be improved in corrosion resistance.

To test mechanical properties of the samples while varying the temperature of a tempering, the samples prepared going through the austnization heat treatment were processed by a tempering heat treatment for 2 hours at a temperature range of 350–750° C.

FIG. 1 shows a graph illustrating a yield stress variation of the example 6 according to a tempering temperature variation.

The graph shows that the stainless steel has the highest strength at a tempering temperature of about 350–575° C. The yield stress variation pattern appears in the identical pattern in the case of other examples.

Figure 2:
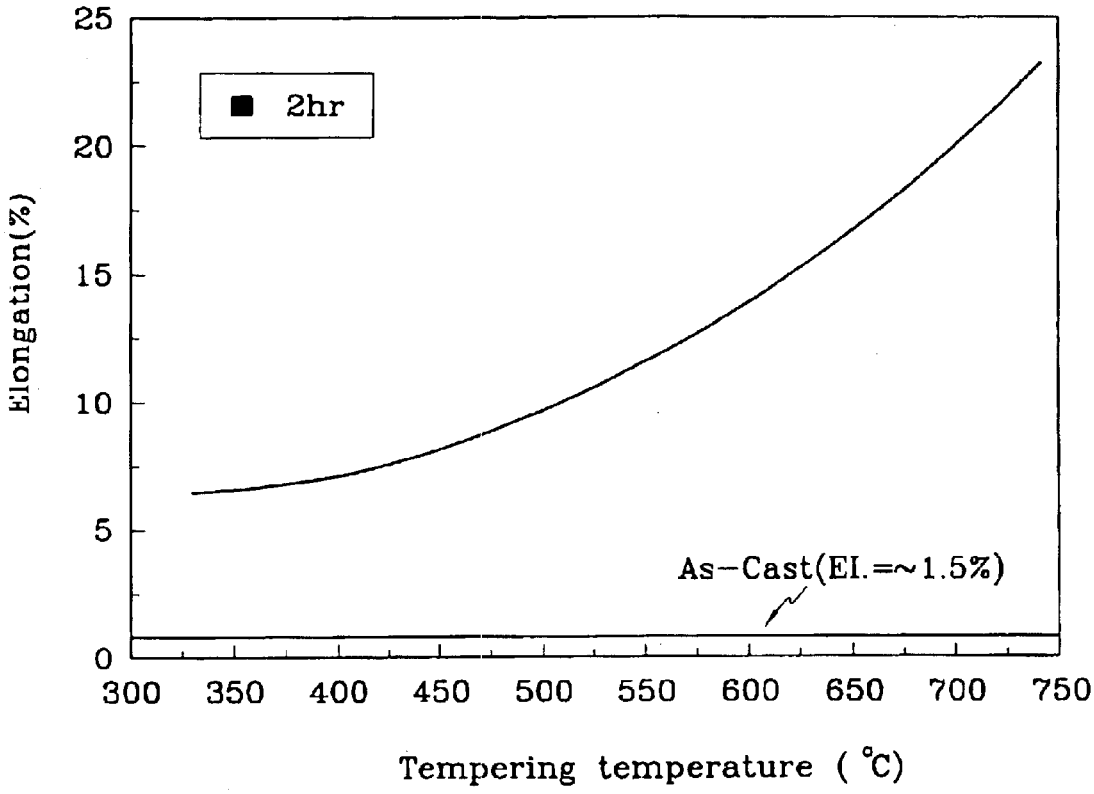
FIG. 2 is a graph illustrating a variation in elongation of a test sample of a preferred embodiment of the present invention according to a variation of tempering temperature.

FIG. 2 shows a graph illustrating an elongation variation of the example 6 according to a tempering temperature variation.

The graph shows that when the stainless steel goes through the austnization heat treatment and the tempering process, the elongation thereof is highly increased. The elongation variation pattern appears in the identical pattern in the case of other examples.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A martensitic stainless steel with high strength and high corrosion resistance comprising less than 0.035 wt. % C, less than 2.5 wt. % Si, less than 2.5 wt. % Mn, 2.0–6.0 wt. % Ni, 13.0–19.0 wt. % Cr, 0.5–6.0 wt. % W, less than 3.5 wt. % Mo, less than 0.5 wt. % Nb, less than 0.5 wt. % V, less than 3.0 wt. % Cu, 0.11–0.25 wt. % N, and the remainder being Fe and minor impurities, wherein the content of $Cr_{23}C_6$ is minimized.

2. A martensitic stainless steel of claim 1 further comprising at least one of less than 0.8 wt. % Ti and/or 1.0 wt. % Ta.

3. A martensitic stainless steel with high strength and high corrosion resistance comprising less than 0.035 wt. % C, less than 2.0 wt. % Si, less than 2.0 wt. % Mn, 2.0–4.5 wt. % Ni, 13.0–16.0 wt. % Cr, 0.5–4.5 wt. % W, less than 2.5 wt. % Mo, less than 0.3 wt. % Nb, less than 0.3 wt. % V, less than 2.0 wt. % Cu, 0.11–0.25 wt. % N, and the remainder being Fe and minor impurities, wherein the content of $Cr_{23}C_6$ is minimized.

4. A martensitic stainless steel of claim 3 further comprising at least one of less than 0.8 wt. % Ti and/or 1.0 wt. % Ta.

5. A method for manufacturing a martensitic stainless steel with high strength and high corrosion resistance comprising the steps of:

casting a stainless steel that comprises less than 0.035 wt. % C, less than 2.5 wt. % Si, less than 2.5 wt. % Mn, 2.0–6.0 wt. % Ni, 13.0–19.0 wt. % Cr, 0.5–6.0 wt. % W, less than 3.5 wt. % Mo, less than 0.5 wt. % Nb, less than 0.5 wt. % V, less than 3.0 wt. % Cu, 0.11–0.25 wt. % N, and the remainder being Fe and minor impurities, wherein the content of $Cr_{23}C_6$ is minimized; and submitting the cast stainless steel to an austenization heat treatment at a temperature of 800–1150° C. and tempering the stainless steel at a temperature of 350–575° C.

6. A method of claim 5 wherein the stainless steel further comprises at least one of less than 0.8 wt. % Ti and/or 1.0 wt. % Ta.

7. A method for manufacturing a martensitic stainless steel with high strength and high corrosion resistance comprising the steps of:

casting a stainless steel that comprises less than 0.035 wt. % C, less than 2.5 wt. % Si, less than 2.5 wt. % Mn, 2.0–6.0 wt. % Ni, 13.0–19.0 wt. % Cr, 0.5–6.0 wt. % W, less than 3.5 wt. % Mo, less than 0.5 wt. % Nb, less than 0.5 wt. % V, less than 3.0 wt. % Cu, 0.11–0.25 wt. % N, and the remainder being Fe and minor impurities, wherein the content of $Cr_{23}C_6$ is minimized;

mechanically-processing the stainless steel such that work hardening is generated in the stainless steel; and submitting the mechanically-processed stainless steel to an austenization heat treatment at a temperature of 800–1150° C. and tempering the stainless steel at a temperature of 350–575° C.

8. A method of claim 7 wherein the stainless steel further comprises at least one of less than 0.8 wt. % Ti and/or 1.0 wt. % Ta.

* * * * *